US005222700A

United States Patent [19]

Kais et al.

[11] Patent Number: 5,222,700

[45] Date of Patent: Jun. 29, 1993

[54] DEVICE FOR LOCKING A SWITCH BLADE

[75] Inventors: Alfred Kais, Lich-Eberstadt; Erich Nuding, Aalen; Sebastian Benenowski, Butzbach, all of Fed. Rep. of Germany

[73] Assignee: BWG Butzbacher Weichenbau GmbH, Butzbach, Fed. Rep. of Germany

[21] Appl. No.: 694,545

[22] Filed: May 2, 1991

[30] Foreign Application Priority Data

May 4, 1990 [DE] Fed. Rep. of Germany ..... 4014249

[51] Int. Cl.[5] ..... E01B 7/20

[52] U.S. Cl. ..... 246/443; 246/448

[58] Field of Search ..... 246/358, 415 R, 430, 246/435 R, 438, 439, 443, 448, 452

[56] References Cited

U.S. PATENT DOCUMENTS

| | | | |
|---|---|---|---|
| 1,550,117 | 8/1925 | Smith | 246/401 X |
| 3,836,771 | 9/1974 | Berst | 246/448 |
| 4,860,978 | 8/1989 | Durchschlag et al. | 246/448 |
| 4,921,189 | 5/1990 | Callegari | 246/488 |

FOREIGN PATENT DOCUMENTS

| | | | |
|---|---|---|---|
| 0320636 | 6/1989 | European Pat. Off. . | |
| 361444 | 4/1922 | Fed. Rep. of Germany . | |
| 2345184 | 3/1975 | Fed. Rep. of Germany | 246/443 |
| 2352017 | 4/1975 | Fed. Rep. of Germany | 246/443 |
| 2450802 | 4/1976 | Fed. Rep. of Germany | 246/443 |
| 2635231 | 2/1978 | Fed. Rep. of Germany | 246/435 R |
| 2449161 | 9/1980 | France . | |
| 358825 | 1/1962 | Switzerland | 246/435 R |
| 104412 | 3/1917 | United Kingdom | 246/448 |

OTHER PUBLICATIONS

Prospekt der Fa. INTEGRA, CH-8304 Wallisellen: Klinkenverschlusse CKA, B est. No. HTS 3306/179, eingeg. Okt. 1979.

*Primary Examiner*—David A. Bucci
*Assistant Examiner*—Scott L. Lowe
*Attorney, Agent, or Firm*—Beveridge, DeGrandi, Weilacher & Young

[57] ABSTRACT

A device for locking a switch blade with a stock rail which includes a locking piece connected to the stock rail. The locking piece has an opening through which the longer leg of an L-shaped locking clamp extends. A switch element also extends through the opening and has an upper surface in contact with the longer leg of the L-shaped member which extends below the foot of the switch blade. The shorter leg has an end free to articulate with respect to a shaft. The shaft is further connected with a clamp receiver or clamp notch. The pivot axis of the clamp receiver member and shorter leg extends parallel with the switch blade and is positioned above the foot of the switch rail such that the clamp receiver member slopes downwardly between the shaft and connection point with the switch blade. This arrangement avoids tipping of the switch as the vertical force vector of the resultant vector passing through the contacting surface of the switching element and first leg intersects the switch blade rail foot on a supporting base immediately adjacent to the switch blade rail foot.

14 Claims, 3 Drawing Sheets

DEVICE FOR LOCKING A SWITCH BLADE

FIELD OF THE INVENTION

The present invention relates to a device for locking a switch blade with a stock rail comprising a lock piece that extends from the stock rail, a sliding element such as a push rod, and a locking element such as a locking clamp passing through the lock piece. The sliding element and locking element interact reciprocally with the lock piece. The locking clamp is so articulated onto the switch blade, which can rest with its rail foot on a base and slide on this, such that the locking element can pivot about an axis that extends in the longitudinal direction of the switch blade, preferably above the rail foot. In which connection, when the switch blade is closed, the locking element can be secured between the slide and the lock piece in a supporting area that extends beneath the foot of the stock rail, this being effected by a resultant force that runs between the supporting area and the axis.

BACKGROUND DISCUSSION

In a usual locking clamp, the axis of rotation of the locking clamp runs beneath the foot of the stock rail so that in the closed position a force component that is approximately parallel to the slide chair acts on the switch blade and this ensures that it closes. Since the point of rotation of the clamp is beneath the foot of the stock rail, this also causes the blade to twist, and this causes the stock rail and the switch blade to move apart. The amount of such twisting becomes greater, the greater the force that is introduced. In addition, when a force is applied in this way, it is not possible to hold the switch blade down without using additional means.

U.S. Pat. No. 4,921,189 (EP-A 0 320 636) describes a switch locking system in which an L-shaped locking clamp runs above the rail foot of the switch blade. The resultant force that causes the switch blade to rest against the stock rail, and which passes between the shaft and the locking clamp support that runs beneath the foot of the stock rail, is such that the vertical force component intersects the base on which the switch blade is moved back and forth at such a large distance from the rail foot that the greater the resultant force, the more powerfully the locking clamp pulls the switch blade to the stock rail, and the more the switch blade will be tilted, so that a gap will open up between this and the stock rail.

SUMMARY OF THE INVENTION

It is the task of the present invention to so develop a device of the type described in the introduction hereto, which is used to lock a switch blade, that any twisting of the switch blade in the closed position is precluded and, at the same time, the switch blade is held down, to the extent that is required. In other words, in a switch, the rail foot is to be pressed onto the slide chair and the rail head is to be pressed against the stock rail.

In addition, ease of operation of the lock is to be ensured in that those parts that are attached rigidly to the rail or to the blade are made as light as possible in order to prevent large acceleration forces.

In addition, it is intended to avoid any tipping or jamming of the switch blade relative to the stock rail.

According to the present invention, this task has been solved on the one hand, essentially in that the vertical force component of the resultant force intersects the rail foot or the base in the immediate vicinity of the rail foot.

The present invention seeks to ensure that the vertical component of the resulting force prevents the switch blade from tipping when otherwise, as in the prior art, a gap opens up between the stock rail and the switch blade.

Understandably, this avoidance of any tipping can not only be prevented if the vertical component of the force intersects the rail foot of the switch blade, but also when the component of the force intersects the base in the immediate vicinity of the rail foot.

In particular, it is intended that the resultant force intersect the transitional area between the rail foot and the web of the switch blade, which ensures that the components of the resultant force intersect the switch blade in the area of its rail foot, on the one hand, and on the other in the area of the rail head—indeed the surface that is adjacent to the stock rail—such, that on the one hand, the rail foot is pressed onto the slide chair and, on the other hand, the rail head is pressed against the stock rail.

The configuration of the components that make up the force vector that is proposed by the present invention is achieved, in particular, if the distance between the axis and the switch blade is kept as small as possible. It is preferred that the distance between the axis of rotation and the proximate surface of the switch-blade web is approximately equal to 0.94 times the height of the switch blade in this area, in which connection the axis runs at approximately 0.56 times the height of the switch blade above the slide chair. In this regard, the distance can, if necessary, be increased by 50 mm or reduced by 20 mm. The distance to the slide chair can vary within ±20 mm. These figures apply, basically, to UIC rails that are 120 mm high.

The measures according to the present invention seek to ensure that the switch blade cannot be tipped when in the locked position, even if major forces are applied to it, and thus cannot be twisted, and that, at the same time, it can be held down securely on the base, which is to say the slide chair, without any additional means.

In order to prevent the switch blade from tilting or jamming relative to the stock rail, according to an independently proposed solution, it is foreseen that the locking element such as the locking clamp starts from a shaft, along which it can be moved and which in its turn forms a rigid unit with the switch blade. Because of this, it is possible for the locking element to move along the shaft which, in particular, precludes any jamming or tilting of the locking element relative to the switch blade, particularly of the sort that can occur as a result of temperature changes and which could result in jamming.

In addition, a flexible bushing can be arranged between the section and the shaft in order to spring the locking element, and thus the locking clamp.

Because of these design features, on the one hand it is ensured that the locking clamp can move longitudinally, and on the other, it provides a damping effect so that the oscillating masses are minimized.

In order to ensure ease of operation and, at the same time, to reduce the use of lubricants to a minimum, the area of the locking element that interacts reciprocally with the sliding element can be configured as a sliding element such as a slide head. One possible embodiment incorporates a roller.

BRIEF DESCRIPTION OF A PREFERRED EMBODIMENT

Additional details, advantages, and features of the present invention are described not only in the claims but are also described, either alone or in combination, in greater detail in the description which follows and in the drawings appended hereto. These drawings show the following:

FIG. 1: a cross section through a switch;

FIG. 2: a plan view of the elements shown in FIG. 1, by means of which the switch is closed;

FIG. 3: an enlarged view of a locking clamp;

FIG. 4: a plan view of the elements that form the locking clamp;

FIG. 5: a view in direction A shown in FIG. 3;

FIG. 6: a locked switch showing the effective force vectors.

DETAILED DESCRIPTION OF A PREFERRED EMBODIMENT

Figure 1:
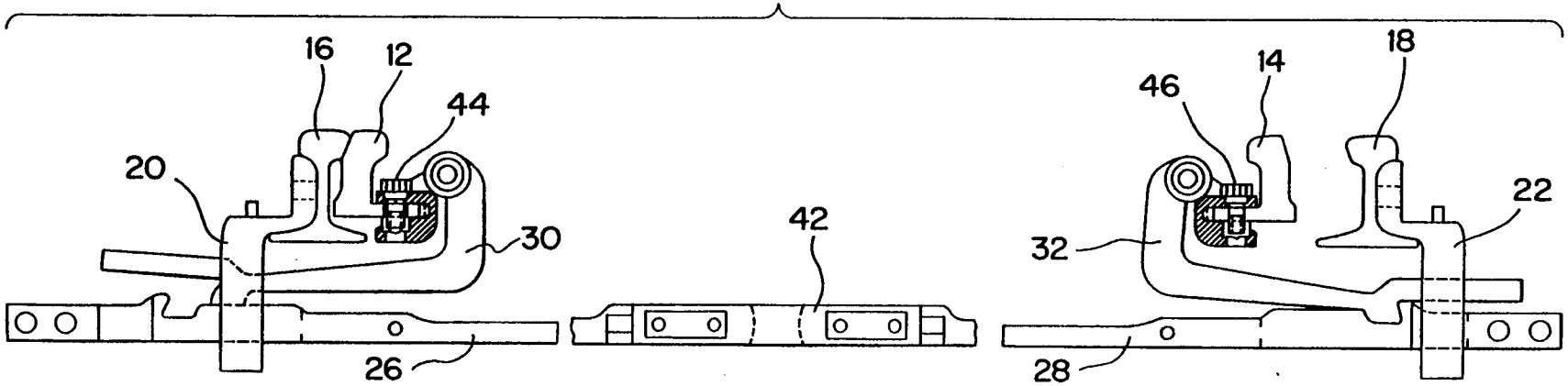
Figure 2:
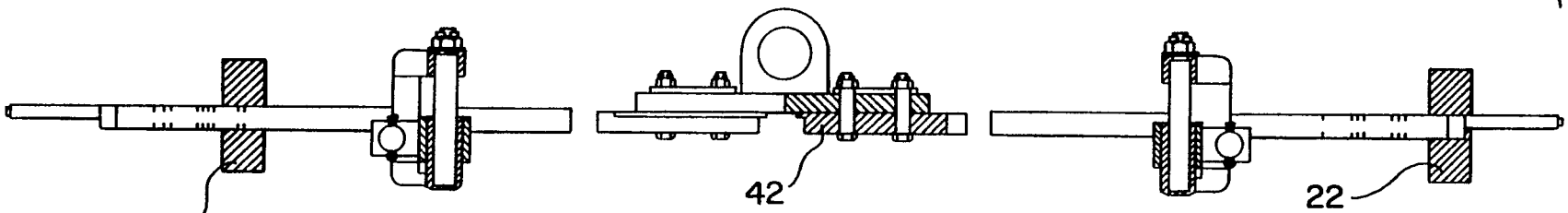

The drawings, in which identical elements bear identical reference numbers, show a section of a switch in which switch blades (12), (14) which are supportable on a base such as a slide chair (11) and which can be moved back and forth on this, are to be locked or opened as desired with an associated stock rail (16) or (18), respectively. The locking clamps that are used for this purpose comprise a lock piece (20) or (22), respectively, that runs from the stock rail, this lock piece incorporating a rectangular opening through which passes a push rod (26) or (28), respectively, and a section of a locking clamp (30) or (32), respectively. On its side that is remote from the stock rail (16) or (18), respectively, the rectangular opening (24) incorporates an extension that is formed by an incline (34) which then interacts with a corresponding section (36) of the locking clamp (30), when the switch blade (12) is locked, and is thus to lie against the stock rail (16). The areas of the incline (34) and the section (36) that lie one on top of the other are to be referred to as the supporting area (35).

As is generally known, the locking clamp (30) also incorporates a projection (38) that extends in the direction of the push rod (26), which then moves into a corresponding matching notch (40) of the push rod (26) when the switch blade (12) is spaced apart from the stock rail (16), which is to say is to be opened, in that the push rod (26) is moved to the right, or the push rod (28) is moved to the left, respectively. The open position is shown in the right-hand part of FIG. 1.

The geometry of the push rods (26) and (28) are identical and are preferably connected through an insulating piece (42), adjustment being effected in the known manner by slots in order to permit adjustment of the spacing.

The locking clamp (30) or (32), respectively, is articulated to the clamp notch (44) or (46), respectively, as described below, although for reasons of clarity only the locking clamp (30) will be described in detail. However, the locking clamp (32) with the clamp notch (46) and the remaining elements are of identical construction.

The clamp notch (44) extends from the rail foot (48) of the switch blade (12) that is remote from the stock rail (16) and incorporates a shaft (50) that extends above the rail foot (48) and which is held by the cheeks of the clamp notch (46) (not shown in greater detail herein). The shaft (50) forms the axis of rotation (52) for the locking clamp (30) and lies above the rail foot (48) of the switch blade (12). Because of this, the locking clamp (30) is L-shaped, the short arm (54) enclosing the shaft (50) with a section (56). In addition, there is a flexible bushing (58) between the section (56) and the shaft (50).

The longitudinal dimension of the section (56) and of the bushing (58) is less than the unattached length of the shaft (50) so that the locking clamp (30) can move back and forth on the shaft (50). In addition, the locking clamp (30) is sprung by the flexible bushing (58).

Figure 3:
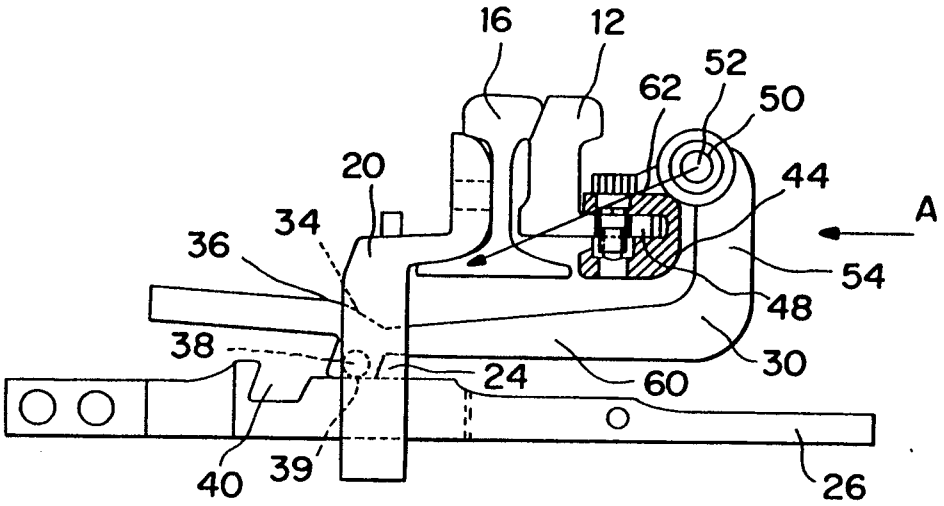
Figure 4:
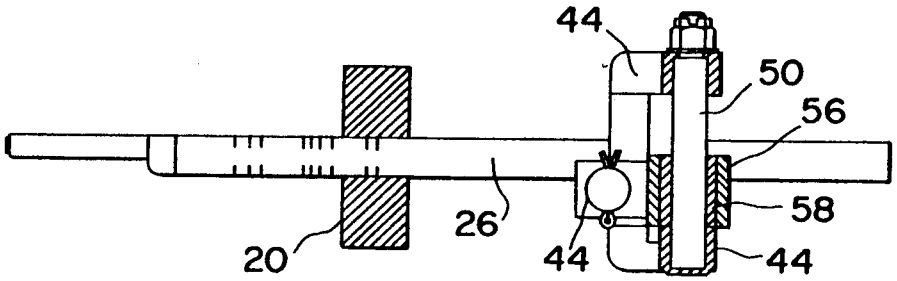
Figure 5:
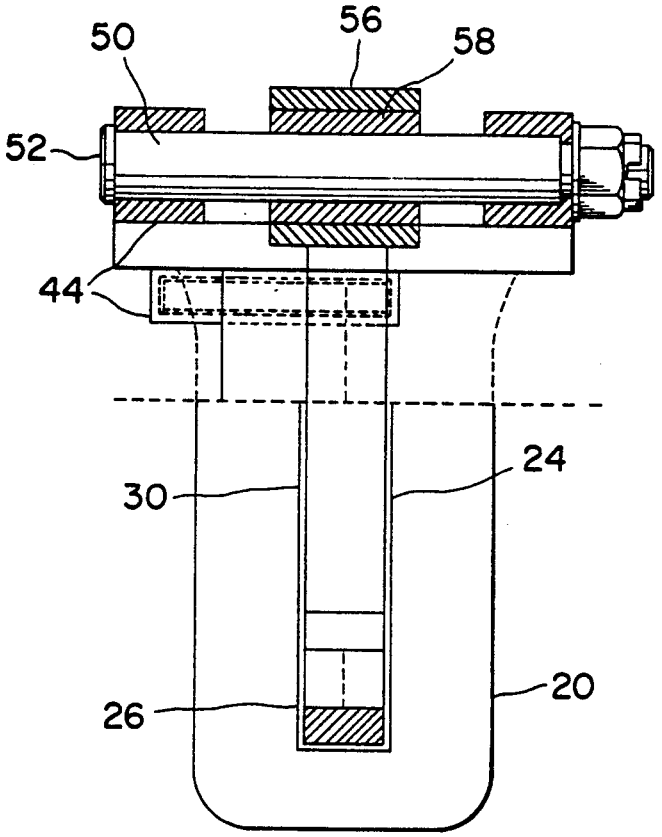

As can be seen, in particular, from FIG. 3, the long section (60) of the locking clamp (30) that runs approximately parallel to the rail foot of the stock rail (16) or of the switch blade (12), respectively, incorporates the inclined section (36) and the projection (38) that are necessary for secure attachment. The section (38) of the locking clamp (30) that is moved along the push rod (26) can be configured as a slide head or roller (39), in order to ensure ease of movement. This can also entail the advantage that the quantity of lubricants that are used is reduced.

Because of the fact that the axis of rotation (52) of the locking clamp (30) runs above the rail foot (48) there is a force vector or a resultant force when the switch blade (12), is closed as is indicated in the drawing by the arrow (62), which precludes any twisting of the switch blade towards the stock rail and simultaneously ensures that the switch blade (12) is held down without the need for any additional means.

Figure 6:
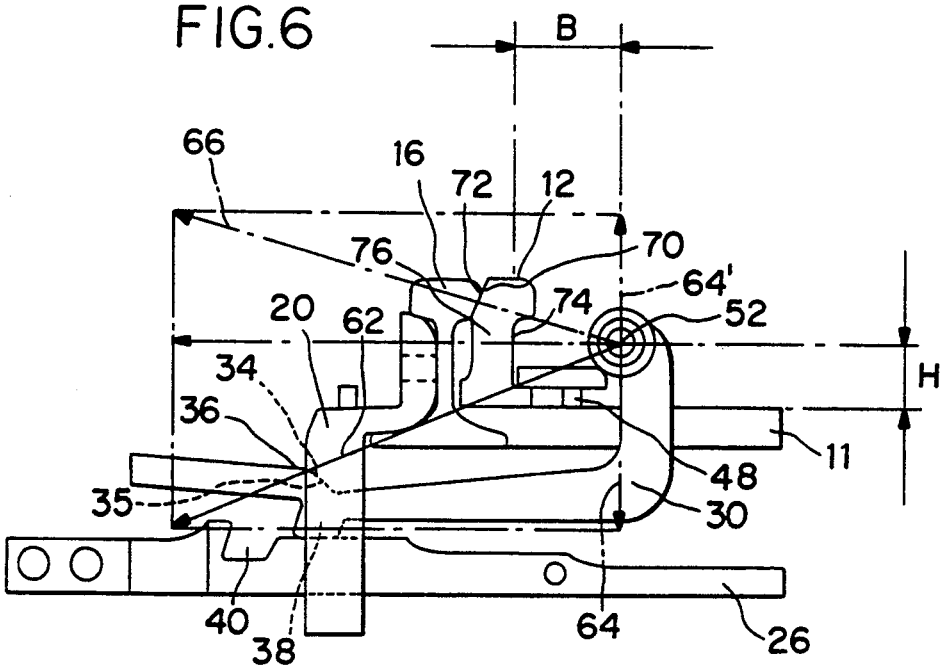

FIG. 6 also shows the force vector or the resultant force (62) and force components (64) and (66) that bring about the locking in order to further clarify the concept of the present invention.

When the switch blade (12) is closed, the force vector (62) runs between the axis (52) about which the locking clamp (30) can be rotated, and the supporting area (35) between the geometrically matched inclines (34) and (36) of the lock piece (20) and the locking clamp (30). The magnitude and the direction of the vector (62) between the axis (52) and the supporting area (35) are so selected that the vertical force component (64) intersects the foot (48) of the switch blade (12) or at least passes in the vicinity thereof, thereby ensuring that the switch blade (12) cannot tip, regardless of the magnitude of the force that is introduced through the locking clamp (30). The additional component (66) intersects the contact surfaces (70) and (72) of the switch blade (12) and the stock rail perpendicularly. FIG. 6 also reveals that the sum of the vertical force vectors 64 and 64' is downwardly directed so that the requirement for additional clamping means to hold down the rail from raising is avoided.

In order that the vertical component (64) that passes through the base or the slide chair vertically, intersects the rail foot (48) directly or else passes in its immediate vicinity, the axis (52) must be arranged close to the switch blade. Preferably, when this is done, the distance B of the shaft (52) from the proximate surface (74) of the web (76) of the switch blade amounts to 0.94 times the height of the switch blade (12). Furthermore, the axis (52) lies at a distance H above the surface of the base (11), the distance H being preferably 0.56 times the distance B. The distance can, if necessary, be increased by 50 mm, or reduced by 20 mm. The distance to the slide chair can be varied by ±20 mm. These details apply, fundamentally, for UIC rails that are 120 mm high.

Further elements of the locking clamp configured according to the present invention correspond to those that are known from earlier clamping locks so that there is no need for a more detailed description of their construction and operation. However, in the present case, all of the parts that are connected to the stock rail (16) or the switch blade (12), respectively, are to be made as light as possible in order to prevent large acceleration forces.

We claim:

1. A device for locking a switch blade with a stock rail, with the stock rail having a rail foot and the switch blade having a rail foot in sliding engagement with a base, comprising:

a locking piece connected with the stock rail;

a sliding element passing through said locking piece and adapted for reciprocal travel with respect to said locking piece between a switch blade locking position and a switch blade unlocking position; and a locking element passing through said locking piece and connected to the switch blade, said locking element including a locking clamp that is rotatable around a swivel axis running parallel to the switch blade, the swivel axis being positioned above the switch blade rail foot and on a side of the switch blade that faces away from the stock rail, said locking clamp extending beneath the stock rail and between the sliding element and the locking piece, and, when the sliding element is in the switch blade locking position, said sliding element is positioned so as to clamp said locking element against a support area of said locking piece such that a resultant force (62) is provided which is directed along a line extending between the swivel axis and the support are and features a vertical force component which is directed along a line that intersects within an area that ranges from the switch blade rail foot to the base in the immediate vicinity of the switch blade rail foot in a manner which avoids tilting of the switch blade.

2. A device as defined in claim 1, characterized in that the locking clamp is L-shaped with a shorter and a longer arm, the shorter arm (54) is articulated with a clamp receiver member (44) that extends from the switch blade (12), characterized in that said clamp receiver member (44) incorporates a shaft (50); in that the shaft (50) is enclosed by a section (56) of said locking clamp; and in that the section (56) can be moved along the shaft (50).

3. A device as defined in claim 2, characterized in that a flexible bushing (58) is arranged between the section (56) and the shaft (50).

4. A device as defined in claim 1, characterized in that within an area (38) of said sliding element that interacts reciprocally with the locking element (30), the sliding element includes a slide facilitating head member for reducing frictional contact between said sliding element and said locking element.

5. A device as defined in claim 4, characterized in that the slide facilitating head member is a slide roller (39).

6. A device according to claim 1, wherein the switch blade includes a transitional area between a web portion of the switch blade and the switch blade rail foot, and the resultant force (62), which is directed along a line extending from the swivel axis positioned above the switch blade rail foot and through the support area positioned below the switch blade rail foot, further extends through the transitional area.

7. A device for locking a switch blade to a stock rail, comprising:

a locking piece connected to the stock rail;

a locking element having a locking clamp and a clamp receiver member, said locking clamp extending underneath said switch blade and through said locking piece, said clamp receiver member having a first end fixed to a rail foot of said switch blade, a second end pivotably connected to said locking clamp about a swivel axis extending parallel to said switch blade, said swivel axis being positioned above said switch blade rail foot such that a section extending from the first end of said clamp receiver member to the second end of said clamp receiver member slopes upwardly; and a sliding element which extends through said locking piece and includes a camming surface in contact with said locking clamp.

8. A device according to claim 7 wherein said locking clamp includes a projection adapted for contact with the camming surface of said sliding element.

9. A device according to claim 8 wherein said camming surface includes a recess that is dimensioned to receive said projection, and said projection includes a roller to facilitate travel of said locking clamp over the camming surface when said sliding element shifts in position.

10. A device according to claim 7 wherein said locking element includes a shaft having a longitudinally extending central axis coinciding with said swivel axis and the second end of said clamp receiver member is connected to said shaft and said locking clamp includes a first end secured to said shaft, and said locking clamp and clamp receiver member are secured to said shaft such that at least one of locking clamp and clamp receiver member is longitudinally displaceable along said shaft.

11. A device according to claim 10 wherein said clamp receiver member includes longitudinally spaced cheeks secured to said shaft and the first end of said locking clamp includes a passageway through which said shaft extends and the first end of said locking clamp being positioned between said cheeks.

12. A device according to claim 11 further comprising a flexible bushing positioned within the passageway in the first end of said locking clamp and in contact with said shaft and said locking clamp.

13. A device according to claim 7 wherein said locking piece includes an opening having an upper end defined by a transversely sloping upper surface in said locking piece, and said locking clamp is positioned above said sliding element and includes an inclined section on an upper surface adapted for contact with the sloping upper surface of said locking piece as well as a projection extending from a lower surface of said locking clamp and into contact with the camming surface of said sliding element.

14. A device according to claim 13 wherein the camming surface of said sliding element includes a notch having a shape which corresponds to that of said projection.

* * * * *